United States Patent [19]

Ohe et al.

[11] Patent Number: 4,717,920

[45] Date of Patent: Jan. 5, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 801,770

[22] Filed: Nov. 26, 1985

[30] Foreign Application Priority Data

Nov. 27, 1984 [JP] Japan ..... 59-251245
Nov. 28, 1984 [JP] Japan ..... 59-252286

[51] Int. Cl.[4] ..... H01Q 1/32

[52] U.S. Cl. ..... 343/712; 343/713; 343/842; 343/866

[58] Field of Search ..... 343/711, 712, 713, 866, 343/842, 788

[56] References Cited

U.S. PATENT DOCUMENTS

| | | | |
|---|---|---|---|
| 2,481,978 | 9/1949 | Clough | 343/712 |
| 2,740,113 | 3/1956 | Hemphill | 343/787 |
| 2,971,191 | 2/1961 | Davis | 343/712 |
| 3,066,293 | 11/1962 | Davis | 343/712 |
| 3,364,487 | 1/1968 | Maheux | 343/713 |
| 3,717,876 | 2/1973 | Volkers et al. | 343/712 |
| 3,916,413 | 10/1975 | Davis | 343/712 |
| 3,961,292 | 6/1976 | Davis | 343/712 |
| 3,961,330 | 6/1976 | Davis | 343/712 |
| 4,080,603 | 3/1978 | Moody | 343/712 |

FOREIGN PATENT DOCUMENTS

| | | | |
|---|---|---|---|
| 1131762 | 6/1962 | Fed. Rep. of Germany . | |
| 1949828 | 10/1969 | Fed. Rep. of Germany . | |
| 46617 | 4/1980 | Japan | 343/712 |

*Primary Examiner*—William L. Sikes
*Assistant Examiner*—Robert E. Wise
*Attorney, Agent, or Firm*—Cushman, Darby & Cushman

[57] ABSTRACT

An automobile antenna system integrally mounted on the vehicle body detects the high-frequency surface currents induced on the vehicle body by broadcast waves. The antenna system includes a high-frequency pickup having a loop antenna and a core around which the loop antenna is wound. The pickup is secured to a predetermined position of the vehicle body by fixture means, and a predetermined side of the loop antenna is opposed to a marginal edge portion of the vehicle body.

3 Claims, 16 Drawing Figures

AUTOMOBILE ANTENNA SYSTEM

BACKGROUND OF THE INVENTION

1. Field of the Invention

The present invention relates to an automobile antenna system and, more particularly, to an improved automobile antenna system for effectively detecting broadcast radio waves received by the vehicle body and then transferring detected signals to various receivers located in the vehicle.

2. Description of the Prior Art

Antenna systems are indispensable to modern automobiles which must positively receive various broadcast waves such as those for radio, television and telephone at the receivers located within the vehicle. Such antenna systems are also very important for citizen band transceivers.

One of the conventional antenna systems is known as a pole-type antenna which projects outwardly from the vehicle body of an automobile. Although such a pole antenna is superior in performance in its own way, it always remains a nuisance from the viewpoint of vehicle body design.

Furthermore, the pole antenna is disadvantageous in that it is subject to damage, tampering or theft and also in that the antenna acts to generate noises during high-speed driving. For these reasons, there has heretofore been a strong desire to eliminate the need for such pole antennas.

With the enlargement of the frequency bands for broadcast or communication waves received at automobiles in recent years, a plurality of pole antennas have been required in accordance with each frequency band. This brings about other problems; a plurality of pole antennas damages the aesthetic appearance of the automobile and the receiving performance is greatly deteriorated by electrical interference between the antennas.

Efforts have been made to eliminate the pole antenna system or to conceal the antenna from the exterior. One such proposal has been to apply a length of antenna wire to the rearwindow glass of an automobile, and this proposal has been put into practical use.

Another proposal has been to detect surface currents which are induced by broadcast waves on the vehicle body of an automobile. This seems to be the most positive and efficient way for receiving broadcast waves, but the experiments carried out to date have not provided any satisfactory results.

One of the reasons why surface currents induced on the vehicle body by broadcast waves have not been utilized well is that their induced value is not as large as expected. Although the prior art mainly uses surface currents induced on the roof panel of the vehicle body, no surface currents of a satisfactory level have been obtained.

Another reason is that surface currents contain noises of a very high level. Such noises are mainly generated by the engine ignition system and the battery charging regulator and cannot be eliminated unless the engine is stopped. Noises transmitted to the interior of the vehicle make it impossible to effect any practicably clear reception of broadcast waves.

In such a situation, some proposals have been made to overcome the above problems. One such proposal is disclosed in Japanese Patent Publication No. 22418/1978 in which electrical insulation is formed at a portion of the vehicle body on which currents are concentrated, with the currents being detected directly by a sensor between the opposite ends of the insulation. Although such structure can detect usable signals which are superior in S/N ratio, a pickup used therein requires a particular cutout in the vehicle body. This cannot be accepted in the mass-production of automobiles.

Another proposal is disclosed in Japanese Utility Model Publication No. 34826/1978 in which an antenna including a pickup coil for detecting currents in the pillar of a vehicle body is provided. This is advantageous in that the antenna can be disposed completely within the vehicle body. However, it is not practical for the pickup coil used therein to be located adjacent to the vehicle pillar in a direction perpendicular to the longitudinal axis of the pillar. Thus, it also appears that this arrangement cannot pick up any usable output from the antenna.

As has been described above, the conventional antenna systems have not been successful in efficiently detecting currents induced on the vehicle body by broadcast waves.

No effective measure has heretofore been proposed for overcoming the above-described principal problems of the conventional art in providing, in particular, a pickup structure for effectively detecting currents induced on the vehicle body by broadcast waves and a pickup arrangement capable of obtaining a usable S/N ratio. The results of various kinds of experiments show that it might in fact be basically impracticable to use an antenna system which utilizes currents flowing on the vehicle body.

SUMMARY OF THE INVENTION

In view of the above-described problems of the prior art, it is an object of the present invention to provide a small-sized improved antenna system for automobiles which is capable of effectively detecting currents induced on the vehicle body by broadcast waves and then transferring detected signals to various receivers located in the vehicle and which is so designed as to facilitate mounting of a high-frequency pickup in a systematic assembling operation and to improve the sensitivity of the pickup.

To achieve this aim, the present invention provides an antenna system having a high-frequency pickup disposed adjacent to a marginal edge portion of the vehicle body for detecting high-frequency surface currents having a frequency of a predetermined value or greater. The high-frequency pickup has a loop antenna, a magnetic core therewithin, and a fixing means for correctly locating and fixing the high-frequency pickup in the vehicle body by a clamping action.

The prior art antenna systems mainly intend to receive AM band waves of a wavelength which is too long to obtain good performance by detection of the surface currents induced on the vehicle body. The inventors paid attention to this question of frequency and made it possible to very efficiently receive signals from surface currents induced on the vehicle body by broadcast waves which are above the FM frequency band (normally, above 50 MHz).

The inventors also took notice of the fact that such high-frequency surface currents are produced at various different locations of the vehicle body in various different densities. Our invention is therefore characterized by the fact that the high-frequency pickup is disposed at the location on the vehicle body that experiences the minimum level of noise and the maximum density of currents induced by broadcast waves. In one preferred form of the present invention, a location capable of satisfying such a condition is particularly to be found at or near the marginal edge of the vehicle body.

Furthermore, the present invention is characterized in that the high-frequency pickup is disposed along the marginal edge of the vehicle body within a range represented by $12\times10^{-3}c/f(m)$, wherein c=the velocity of light and f=the carrier frequency of the broadcast wave, so as to be able to positively detect the high-frequency currents. The pickup adopted for effecting the detection with increased efficiency may be in the form of a loop antenna for electromagnetically detecting magnetic flux induced by surface currents on the vehicle body, of electrode means capable of forming an electrostatic capacity between the pickup and a trunk hinge of the vehicle body so as to electrostatically detect high-frequency signals, or of coil means including a sliding core.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiments of the automobile antenna system according to the present invention will be described hereinunder with reference to the accompanying drawings.

FIGS. 1 to 9 illustrate a process of examining the distribution characteristics of high-frequency currents to know a location at which an antenna system can operate most efficiently on the vehicle body of an automobile.

Figure 1:
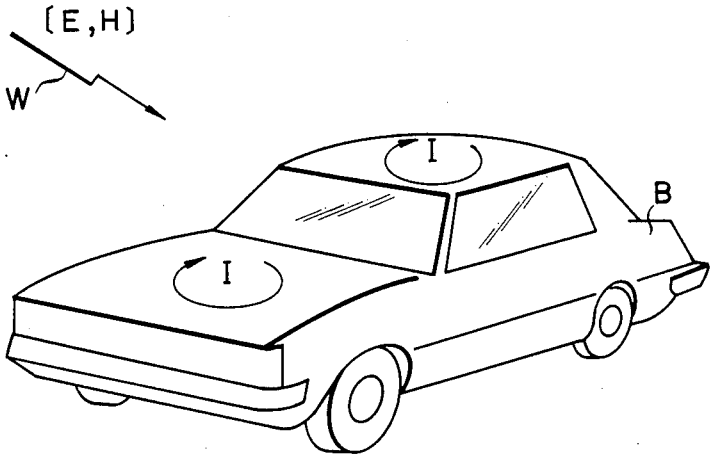
FIG. 1 illustrates surface currents I induced on the vehicle body B by external waves W.

FIG. 1 shows that when external electromagnetic waves W, such as broadcast waves, pass through the vehicle body B of conductive metal, surface currents I are induced at various vehicle locations at levels corresponding to the intensities of electromagnetic waves passing therethrough. The present invention aims at only electromagnetic waves which belong to relatively high frequency bands in excess of 50 MHz, such as FM broadcast waves, television waves and others.

The present invention is characterized in that the distribution of the surface currents induced on the vehicle body by electromagnetic waves within the above-described particular wave bands is measured so as to seek a location on the vehicle body which is higher in surface current density and lower in noise and at which a pickup used in the present invention is to be located.

The distribution of surface currents is determined by a simulation using a computer and also by measuring actual intensities of surface currents at various locations on a vehicle. In accordance with the present invention, the measurement is carried out by the use of a probe which can operate in accordance with the same principle as that of a high-frequency pickup actually located on the vehicle body at the desired location, as will be described later. Such a probe is moved on the vehicle body throughout the entire surface thereof to measure the level of surface currents at various locations of the vehicle body.

Figure 2:
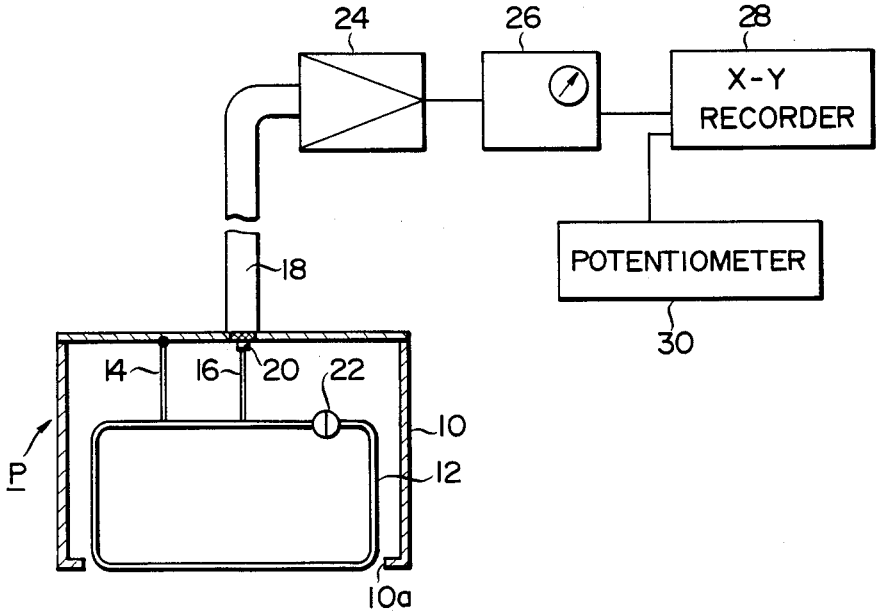
FIG. 2 illustrates a probe for detecting the distribution of surface currents on the vehicle body and having the same construction as that of the high-frequency pickup used in the present invention, and a circuit for processing signals from the probe.

FIG. 2 shows an example of such a probe P which is constructed in accordance with substantially the same principle as that of the high-frequency pickup described hereinafter. The probe P is composed of a casing of electrically conductive material 10 for preventing any external electromagnetic wave from transmitting to the interior thereof and a loop coil 12 rigidly located within the casing 10. The casing 10 includes an opening **10*a* formed therein through which a portion of the loop coil 12 is externally exposed. The exposed portion of the loop coil 12 is positioned in close proximity to the surface of the vehicle body B to detect magnetic flux induced by surface currents on the vehicle body B. Another portion of the loop coil 12 is connected with the casing 10 through a short-circuiting line 14. The loop coil 12 further includes an output end 16 connected with a core 20 in an coaxial cable 18. Still another portion of the loop coil 12 includes a capacitor 22 for causing the frequency in the loop coil 12** to resonate relative to the desired frequency to be measured to increase the efficiency of the pickup.

Thus, when the probe P is moved along the surface of the vehicle body B and also angularly rotated at various locations of measurement, the distribution and direction of surface currents can accurately be determined at each of the vehicle locations. In FIG. 2, the output of the probe P is amplified by a high-frequency voltage amplifier 24 and the resulting output voltage is measured by a high-frequency voltmeter 26. This coil output voltage is read at the indicated value of the high-frequency voltmeter 26 and also is recorded by an XY recorder 28 to provide the distribution of surface currents at various vehicle locations. The input of the XY recorder 28 receives signals indicative of various vehicle locations from a potentiometer 30 to recognize the value of high-frequency surface current at the corresponding vehicle location.

Figure 3:
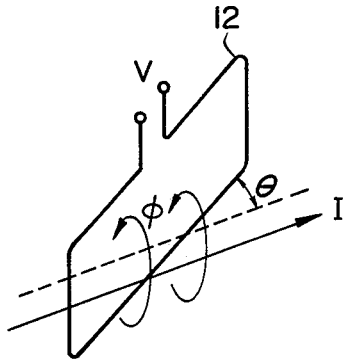
FIG. 3 illustrates the electromagnetic coupling between the surface currents I and the pickup loop antenna.
Figure 4:
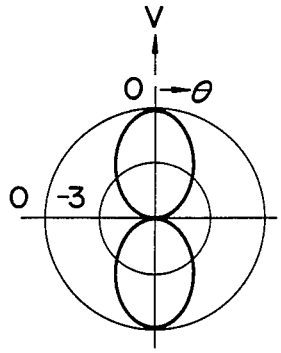
FIG. 4 illustrates the directional pattern of the loop antenna shown in FIG. 3.

FIG. 3 illustrates an angle $\theta$ of deflection between the high-frequency surface currents I and the loop coil 12 of the pickup. As is clear from the drawing, magnetic flux $\phi$ intersects the loop coil 12 to generate a detection voltage V in the loop coil 12. As shown in FIG. 4, when the angle $\theta$ of deflection is equal to zero, that is, the surface currents I are parallel to the loop coil 12 of the pickup, the maximum voltage can be obtained. The direction of the surface currents I when the probe P is rotated to obtain the maximum voltage can also be known.

Figure 5:
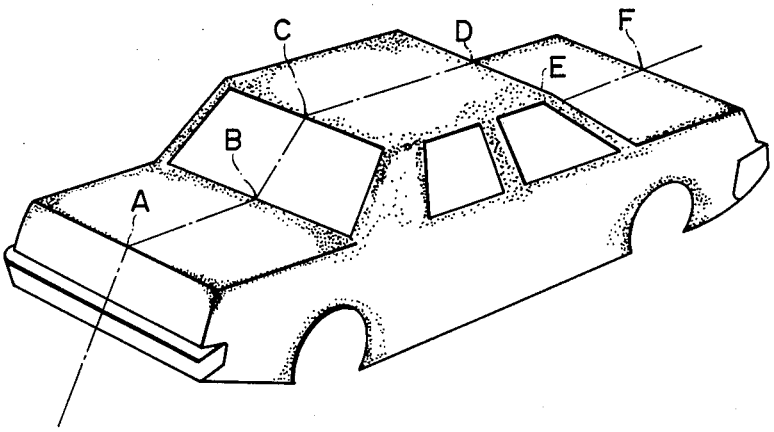
FIG. 5 illustrates the intensity distribution of the surface currents.
Figure 6:
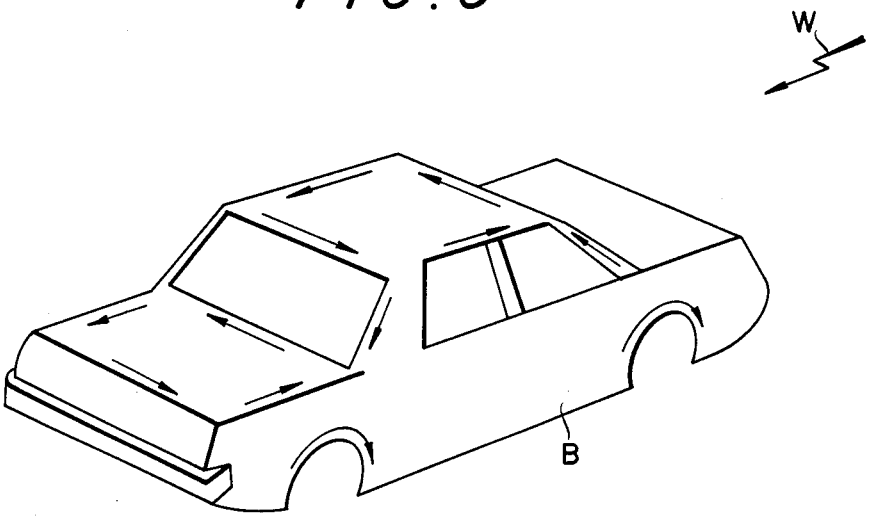
FIG. 6 illustrates the directions of flow of the surface currents.

FIGS. 5 and 6 respectively show the magnitude and direction of high-frequency surface currents induced at various different locations of the vehicle body at the frequency of 80 MHz, the values of which are obtained from the measurements of the probe P and the simulation effected by the computer. As can be seen from FIG. 14, the distribution of surface currents has higher densities at the marginal edge of the vehicle body and lower densities at the central portions of the flat vehicle panels.

It will also be apparent from FIG. 6 that the surface currents are concentrated in the direction parallel to the marginal edge of the vehicle body or in the direction along the connections of various flat panels.

Figure 8:
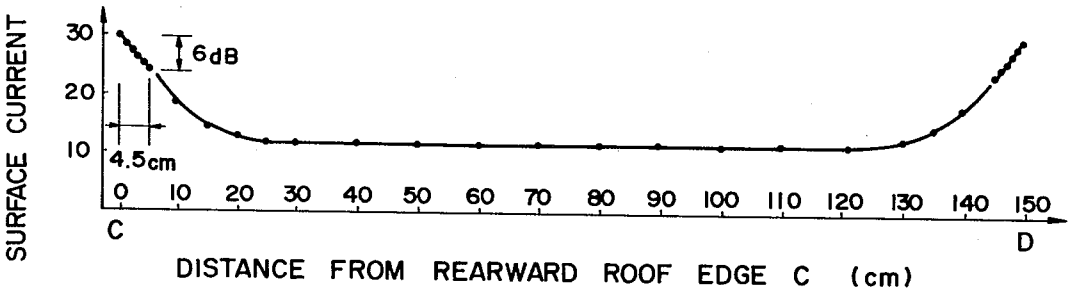
FIGS. 7, 8 and 9 are graphs showing the distribution of surface currents at various locations of the vehicle body shown in FIG. 5 along the longitudinal axis.
Figure 9:
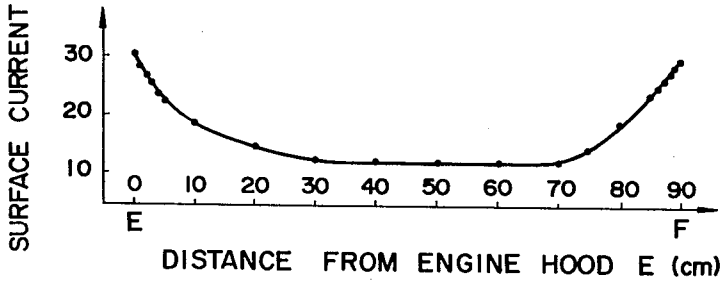
Figure 7:
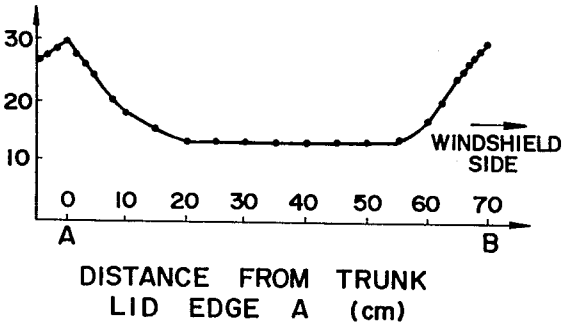

Carefully studying the distribution of surface currents induced at various metallic vehicle portions along the longitudinal axis of the vehicle body as shown in FIG. 6, distribution characteristics such as those shown in FIGS. 7 to 9 can be obtained.

FIG. 7 shows a distribution of surface currents along a trunk lid between two points A and B on the longitudinal axis (see FIGS. 5 and 6). As can be seen from this drawing, the surface currents attain very high levels at these points A and B and decrease toward the central portion of the trunk lid from the opposite points thereof.

Thus, if a high-frequency pickup is disposed near the marginal edge of the trunk lid, the currents concentrating thereon can be detected.

Similarly, FIG. 8 shows the distribution of surface currents along the roof panel of the vehicle body while FIG. 9 shows the distribution of surface crrrents along the engine hood of the vehicle body. As is apparent from these drawings, surface currents of a very high level flow at the marginal edges of the roof panel and the engine hood, respectively. The value of the surface currents decreases toward the central portion of each panel area of the vehicle sections.

It is thus understood that the pickup should be disposed at or near the marginal edge of each panel area of the vehicle body in order to catch broadcast waves with high sensitivity.

It goes without saying that the high-frequency pickup can similarly be located on one of pillars and fenders as well as on the trunk lid, the engine hood and the roof panel in the present invention.

Although the loop antenna of the high-frequency pickup is arranged longitudinally adjacent to and along the marginal edge of each vehicle panel area in accordance with the present invention, this loop antenna is preferably positioned within a range determined depending upon the carrier frequency of broadcast waves in order to obtain sensitivity suitable for practical use.

The distribution of currents shown in FIGS. 7 to 9 relate to the currents induced on the vehicle body by FM broadcast waves having the frequency of 80 MHz. The value of surface currents decreases in accordance with the distance between the position of the surface currents and the marginal portions of the vehicle. Considerirg that good sensitivity can actually be obtained in the range of decreased currents below 6 dB, it is understood that such sensitivity may be realized if the pickup is located within a distance of 4.5 cm from each marginal edge of the vehicle.

Thus, a satisfactory antenna system can be provided in accordance with the present invention if a high-frequency pickup is arranged within a distance of 4.5 cm away from a marginal vehicle portion for the carrier frequency of 80 MHz.

It is found from the computer's simulation and experimental measurements that the above distance which is suitable for practical use depends upon the carrier frequency used therein. It is also recognized that the distance is decreased as the value of the carrier frequency is increased.

From the fact that the suitable distance of 4.5 cm from the corresponding marginal vehicle portion is inversely proportional to the value of the carrier frequency, good results can be obtained relative to the respective values of the carrier frequency if the high-frequency pickup is spaced away from the marginal edge of a metallic vehicle panel within a distance represented by the following formula:

$$12\times10^{-3}c/f(m)$$

where c=the velocity of light and f=carrier frequency.

In this manner, the present invention provides an improved high-frequency pickup which is located adjacent to the marginal edge of each panel area of the metallic vehicle body and which is preferably disposed within said range from that marginal edge.

For example, where a carrier frequency equal to 100 MHz is to be caught, a high-frequency pickup may be disposed at a vehicle location spaced away from a desired marginal edge of the vehicle body within a distance of 3.6 cm. It will be apparent that as the value of the carrier frequency f is increased, the distance between the high-frequency pickup and the corresponding marginal edge of the vehicle body will be decreased.

Figure 10:
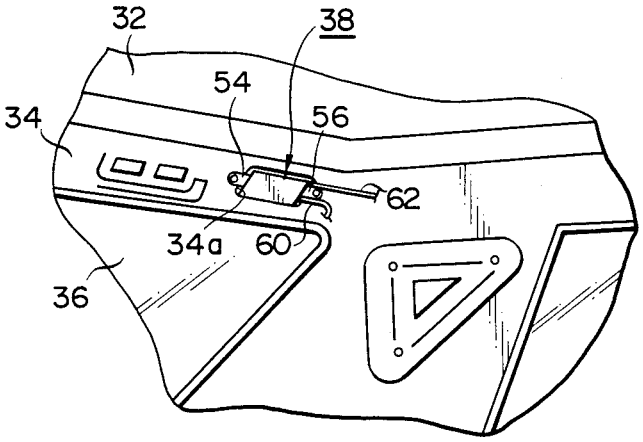
FIG. 10 is a perspective view of the high-frequency pickup in accordance with the present invention, mounted on the roof panel of an automobile.

FIG. 10 shows a high-frequency pickup according to the present invention mounted near the rear marginal edge of the roof panel.

In the drawing, a roof panel 32 is illustrated in the exposed state, and the metallic roof panel 32 is connected to a rearwindow glass 36 with a rear window frame 34 as its marginal edge. In this embodiment, a high-frequency pickup 38 is disposed within a distance of 4.5 cm inward of the rearwindow frame 34.

Figure 11:
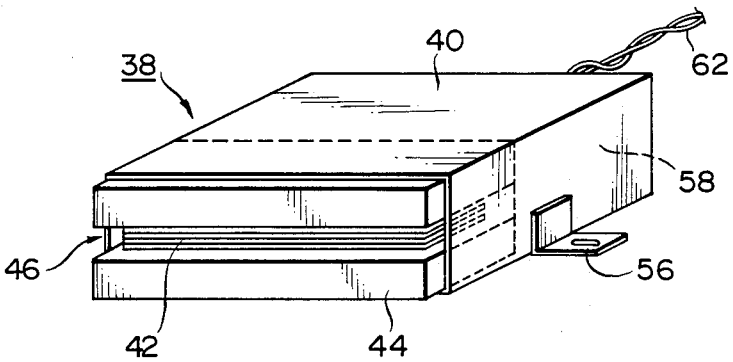
FIG. 11 illustrates the appearance of an automobile antenna system according to the present invention.

FIG. 11 shows the external appearance of a high-frequency pickup. The high-frequency pickup 38 includes a metallic casing 40 for shielding it from undesirable external electromagnetic flux and a core 44 located within the casing 40 and with a loop antenna 42 wound around. Therefore, this pickup is of an electromagnetic coupling type similar to the aforementioned probe including its loop coil for measuring the distribution of surface currents on the vehicle body.

Figure 12:
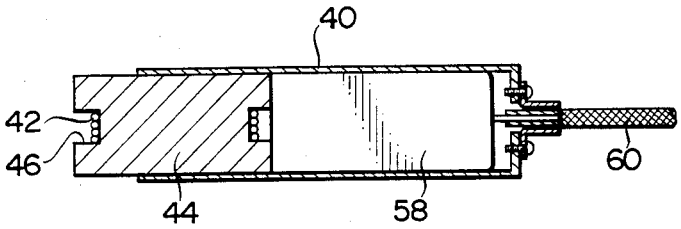
FIG. 12 is a sectional view of the antenna shown in FIG. 11, taken along the line II—II.
Figure 13:
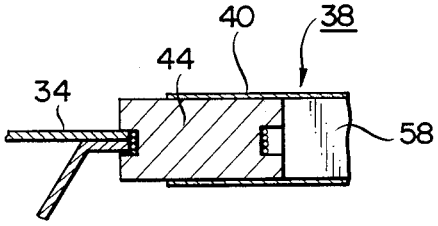
FIG. 13 is a fragmentary sectional view of the pickup shown in FIG. 10.

The core 44 is made of a material of high permiability such as ferrite, and a groove for containing the loop antenna 42 in a wound form is formed on at least one side surface of the core 44. In this embodiment, a grooved portion 46 is formed on the periphery of the core 44, as shown in FIG. 12, and the loop antenna 42 is wound around the grooved portion 46 in a plurality of turns.

Figure 14:
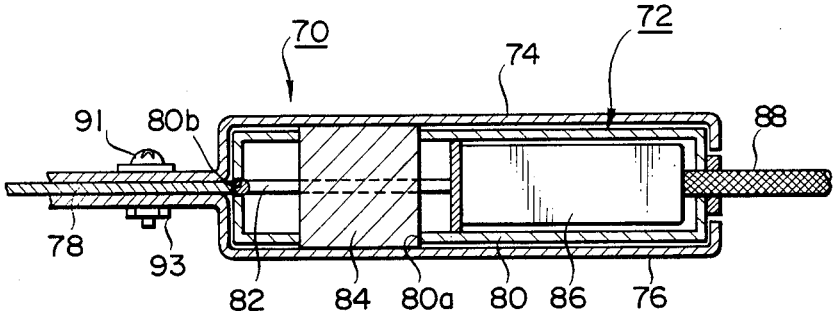
FIG. 14 is a sectional view of another embodiment of an automobile antenna system according to the present invention.

The grooved portion 46 serves as a guide for winding the loop antenna 42, as described above. It is also useful for improving the degree of accuracy in positioning the loop antenna 42 and the marginal edge portion by allowing the high-frequency pickup 38 to be mounted in such a manner that the grooved portion 46 may fit over the marginal edge portion of the vehicle body, as is shown in FIG. 14. In addition, a closed magnetic circuit is formed between the marginal edge portion of the vehicle body and the core 44, so that any leakage of magnetic flux induced by the high-frequency surface current is prevented. Accordingly, the magnetic flux is safely caught by the loop antenna 42 and further the casing 40 shields the magnetic flux from undesirable external electromagnetic flux, so that the current induced on the vehicle body can be detected with good sensitivity by the high-frequency pickup 38.

In order to locate and fix the casing 40 of the high-frequency pickup 38 in relation to the rearwindow frame 34, L-shaped brackets 54 and 56 are provided on both side surfaces of the casing 40. These brackets 54 and 56 are screwed to the rearwindow frame 34.

The casing 40 of the high-frequency pickup 38 includes circuitry 58 contained therein which is connected with the loop antenna 42. The circuitry 58 includes its internal components such as a pre-amplifier and others for processing detected signals. The resulting high-frequency detection signals are externally taken through a coaxial cable 60 and then processed by the same circuit as that used in measuring the distribution of surface currents. The circuitry 58 receives power and control signals through a coaxial cable 62.

The loop antenna 42 is in the form of a compound wound coil which is covered with an insulation such that the coil can be arranged in an electrically insulated relationship with and in close contact with the open marginal portion of the vehicle body. Thus, the magnetic flux induced by the surface currents can intersect the loop antenna 42 with an increased intensity.

In this embodiment, the loop antenna 42 is disposed within a distance of 4.5 cm from the edge portion of the rearwindow frame 34, whereby the FM broadcast waves of the frequency of 80 MHz can be positively detected from the surface currents flowing in the marginal edge portion of the rearwindow frame 34. Since the surface currents on the vehicle flow along its marginal portions, as is clear from FIG. 6, the loop antenna 42 is disposed longitudinally along the marginal edge portion of the rearwindow frame 34.

As described above, in this embodiment, the surface currents flowing along the marginal portions of the vehicle, especially along the marginal portion of the roof panel are electromagnetically detected by the high-frequency pickup, and leakage of magnetic flux is prevented by clamping with the core 44 the marginal edge portion to which the pickup is attached. Thus the pickup in this embodiment enables secure reception in a high-frequency band and provides a very useful pickup for an automobile antenna.

Figure 15:
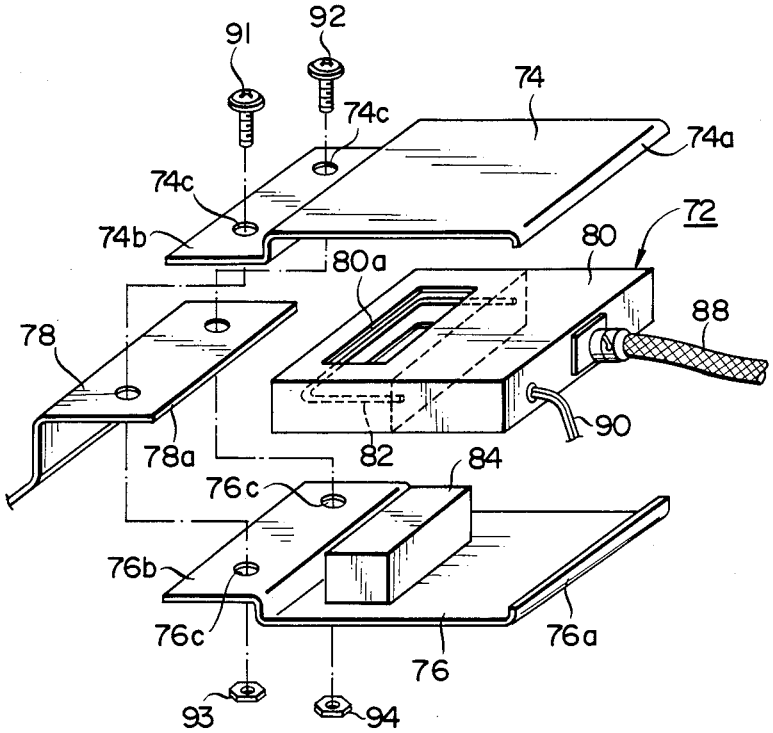
FIG. 15 is an exploded perspective view of the antenna assembly shown in FIG. 14.

FIG. 14 is a section of an antenna assembly with a high-frequency pickup, illustrating another embodiment of the present invention, and FIG. 15 is an exploded perspective view of the antenna shown in FIG. 14.

An antenna assembly 70 is composed of a high-frequency pickup 72, a pair of brackets for clamping the pickup 72 at both sides thereof, and a vehicle body connecting piece 78 which is separated from the vehicle body and to which the brackets 74 and 76 are secured. The structure of the antenna assembly will be described in detail in the following.

The high-frequency pickup 72 includes a metallic casing 80 for externally shielding electromagnetic flux, a loop antenna 82 located within the casing 80, and a core 84 disposed within the loop of the loop antenna 82. Therefore, this pickup constitutes an electromagnetic coupling type pickup similar to the aforementioned probe which includes a loop coil for measuring the distribution of surface currents on the vehicle body. The core 84 is formed of a strong magnetic material such as iron, and is inserted into an opening **80*a* formed on the casing 80 such as to penetrate the upper and lower surfaces thereof in such a manner that the core 84 protrudes slightly from the upper and lower surfaces of the casing 80**.

The casing 80 is also provided with an opening **80*b* such that the longer side of the loop antenna 82 is exposed, and in this way a part of the loop antenna 82 exposed from the casing 80 of a conductive material is arranged such as to face the end surface of the vehicle body connecting piece 78**, as will be described later.

The casing 80 of the high-frequency pickup 72 includes a circuitry 86 contained therein which is connected with the loop antenna 82. The circuitry 86 includes its internal components such as a pre-amplifier and others for processing detected signals. The resulting high-frequency detection signals are externally taken through a coaxial cable 88 and then processed by the same circuit as that used in measuring the distribution of surface currents. The circuitry 86 receives power and control signals through a coaxial cable 90.

The loop antenna 82 is in the form of a single wound coil which is covered with an insulation such that the coil can be arranged in an electrically insulated relationship with and in close contact with the vehicle body connecting piece 78. Thus, the magnetic flux induced by the surface currents can intersect the loop antenna 42 with an increased intensity.

The high-frequency pickup 38 is clamped at both sides thereof by a pair of brackets 74, 76, each having one end thereof rigidly fastened to the marginal portion of the vehicle body. The brackets 74, 76 are each made from a panel of metal and are disposed in an opposed relationship with each other. The brackets 74, 76 respectively have hook portions **74*a*, 76*a* at one end thereof and bent portions 74*b*, 76*b* at the other end which are respectively provided with mounting bores 74*c*, 76*c*. The vehicle body connecting piece 78 is clamped between the bent portions 74*b*, 76*b*. The brackets 74, 76 are integrally secured to the connecting piece 78 by bolts 91, 92 and nuts 93, 94. Thus, the high-frequency pickup 72 is rigidly supported such that the portion thereof containing the loop antenna 82 is housed within a space defined between the hook portions 74*a*, 76*a* and the bent portions 74*b*, 76*b* of the brackets 74, 76, with the loop antenna 82 and the end edge 78*a* of the connecting piece 78** opposing each other.

According to this embodiment, the magnetic flux, induced by the currents flowing at the marginal edge of the vehicle body connecting piece 78 which extends along the marginal portion of the vehicle body, effectively concentrates on the closed magnetic circuit which is composed of the brackets 74, 76 and the core 84. Accordingly, the degree of magnetic flux penetrating the loop antenna 82 is increased and the output voltage supplied from the high-frequency pickup 72 is increased by the same degree, an antenna system of high sensitivity thereby being provided. The working efficiency at the time of mounting is further improved if the core 84 is secured to, for example, one bracket 76 in advance and, when the pickup 72 is clamped by the pair of the brackets 74, 76, the core 84 is inserted into the opening 80*a* which is provided on the pickup 72 in advance.

The high-frequency pickup 72, the brackets 74, 76 and the vehicle body connecting piece 78 constitute in combination an antenna assembly 70 which is integrally mounted on the vehicle body through the connecting piece 78 which is rigidly fastened to the vehicle body. The connecting piece 78 is a separate member obtained by cutting out a portion of the roof panel of the vehicle body on which the antenna assembly 70 is mounted. The connecting piece 78 is mounted at its original position by employing appropriate fastening means, whereby the high-frequency pickup 72 can be readily and systematically mounted within a relatively narrow space.

Figure 16:
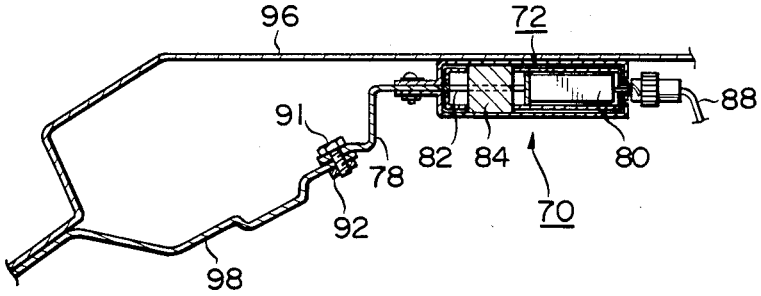
FIG. 16 is a fragmentary sectional view of the antenna assembly mounted on the roof panel of the vehicle body of an automobile.

FIG. 16 is a fragmentary sectional view showing the antenna assembly 70 mounted on the roof panel of the vehicle body.

The roof panel is composed of an outer panel 96 and an inner panel 98. The antenna assembly 70 is mounted on the roof panel through the vehicle body connecting piece 78 which is rigidly fastened to the inner panel 98 by bolts 91 and nuts 92. The bolts 91 employed in this case are preferably grounding bolts since it is necessary to ensure the electrical conduction between the inner panel 98 and the vehicle body connecting piece 78. The degree of accuracy in mounting the above-described antenna assembly 70 can be adjusted as desired by means of the bolts 91 and the nuts 92. In this way, it is possible to minimize possible errors or variations in mounting the antenna assembly 70 and to carry out a systematic assembling operation.

It will be apparent from the foregoing that in accordance with the present invention, the antenna system can receive broadcast waves belonging to relatively high frequency bands such as FM frequency bands or more by detecting the high-frequency surface currents induced particularly at the marginal portions of the vehicle body by its high-frequency pickup. Further the high-frequency pickup which is arranged at a marginal portion of the vehicle body contains the core which is formed such as to clamp the marginal portion therewith. Therefore, the antenna system can effect its good detection with high density and with less noise. Further, the structure of the assembly which is composed of the high-frequency pickup, the brackets and the vehicle body connecting piece makes it possible to mount the high-frequency pickup in a systematic assembling operation and minimize variations in outputs of the pickup.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An automobile antenna system comprising:

high-frequency pickup means having a loop antenna longitudinally disposed along and in close proximity to an end surface of a marginal edge portion of a vehicle body, a core being formed of a material having a high permeability constant value and around which said loop antenna being wound, and a casing having an opening opposite to one side of said loop antenna; said high-frequency pickup means being provided for detecting high-frequency surface currents which are induced by broadcast waves on the vehicle body and which are concentrated on the marginal edge portion of the vehicle body; and fixture means for securing said high-frequency pickup means to a predetermined position of said vehicle body.

2. An automobile antenna system according to claim 1, wherein a grooved portion around which said loop antenna is wound is provided on at least one side surface of said core, and said marginal edge portion of the vehicle body is inserted into said grooved portion.

3. An automobile antenna system according to claim 1, wherein said fixture means comprises:

a pair of brackets for clamping said high-frequency pickup means at two sides thereof, each of said brackets having one end thereof rigidly fastened to said marginal edge portion of the vehicle body; and a vehicle body connecting piece which is cut out from the vehicle body and to which said pair of brackets clamping said high-frequency pickup means therebetween are secured such that said loop antenna of said high-frequency pickup means opposes said marginal edge portion of the vehicle body.

* * * * *